US008292137B2

(12) United States Patent
Schlipper

(10) Patent No.: US 8,292,137 B2
(45) Date of Patent: Oct. 23, 2012

(54) WIRE CABLE REINFORCED CARRYING STRAP

(76) Inventor: Robert Wesley Schlipper, Hong Kong (HK)

( * ) Notice: Subject to any disclaimer, the term of this patent is extended or adjusted under 35 U.S.C. 154(b) by 651 days.

(21) Appl. No.: 12/292,901

(22) Filed: Dec. 1, 2008

(65) Prior Publication Data

US 2009/0140020 A1 Jun. 4, 2009

(30) Foreign Application Priority Data

Nov. 29, 2007 (AU) ..... 2007906511

(51) Int. Cl.
*A45F 3/14* (2006.01)

(52) U.S. Cl. ..... 224/257

(58) Field of Classification Search ..... 224/257, 224/628, 627, 643
See application file for complete search history.

(56) References Cited

U.S. PATENT DOCUMENTS 3,692,253 A * 9/1972 Curran ..... 242/381.4
4,791,709 A * 12/1988 Fildan ..... 24/171
5,123,153 A * 6/1992 Krauss ..... 24/196
7,028,873 B1 * 4/2006 Collier et al. ..... 224/628
2002/0008125 A1 * 1/2002 Caputi ..... 224/257
2002/0062541 A1 * 5/2002 Fildan et al. ..... 24/578.1
2004/0187271 A1 * 9/2004 Mikkelsen ..... 24/170
2007/0251279 A1 * 11/2007 Hollier ..... 70/15
2008/0149676 A1 * 6/2008 Bartel ..... 224/628
2008/0156835 A1 * 7/2008 Schlipper ..... 224/264

* cited by examiner

*Primary Examiner* — Brian D Nash

(57) ABSTRACT

An elongate carrying strap reinforced by longitudinally extending multi-strand wire cables (41) is engaged with a fitting (1) for forming a loop (64) at an end of the strap (2) so as to avoid inelastic deformation of the cable. A pair of multi-strand wire cables are received in parallel envelopes (43) disposed on opposite longitudinal edges of the strap, each envelope is tubular and formed in a flexible polymer strip (40) extruded over the cable. The fitting has a transverse bar portion (71) having a convex face abutting the inner side of the loop and a pair of transverse arm portions (9, 10) defining an opening therebetween, the opening receiving a neck (63) of the loop and having opposing strap-engaging surfaces abutting the outer side of the strap and cooperating to hold the inner side against the convex face (4) of the bar portion (71).

19 Claims, 2 Drawing Sheets

WIRE CABLE REINFORCED CARRYING STRAP

TECHNICAL FIELD

The present invention relates to a carrying strap for a bag, or other item, attached in such manner that it forms a loop, the carrying strap being reinforced by wire cable for security.

BACKGROUND OF THE INVENTION

The use of steel wire cable reinforcement in the construction of flexible carrying straps for baggage provides an increased level of security against theft, particularly that achieved by slicing the strap. A prior art design employs two elongate wire cables to reinforce carrying straps of this type, the wire cables running longitudinally and received in fabric sleeves, formed by folding and sewing one or more panels, with the sleeves extending along opposing edges of the strap. Enveloping the wires within separate elongate apertures in this way keeps the wires separated, helping the strap lie flat in use and avoiding one wire overlying another in a manner which may cause discomfort. It will be understood that although this prior art design also allows the straps to be readily manufactured using conventional sewing techniques, the number of separate manufacturing steps required tends to increase the component of labour costs in straps of this type.

Additionally, the longitudinal ends of straps of this general type typically include a loop by which an end of the strap is fastened to the baggage. Conventionally a length-adjustable strap may have an adjustable loop, through which the strap may be fed to vary the length of the strap. However, a drawback of this prior art strap construction is that if, due to load on the strap, the loop is collapsed to a small diameter then the wires may be permanently deformed, providing a kink in the wire which makes further adjustment difficult. Another disadvantage is that under certain loading conditions weight is unevenly distributed in the transverse direction between both of the wires. This produces, for example, a tendency for the highly loaded wire to dig into the wearer's shoulder with resulting discomfort. Likewise seams along edges of the fabric panels, from which the carrying strap is made, have in the past protruded from the outer contour to the strap and possibly caused some degree of discomfort, depending upon the thickness and stiffness of the fabric along the seam. It is an object of the present invention to overcome or substantially ameliorate the above disadvantages, or more generally to provide an improved wire cable reinforced carrying strap.

DISCLOSURE OF THE INVENTION

According to one aspect of the present invention there is provided a carrying strap assembly including:

an elongate strap reinforced by at least one longitudinally extending multi-strand wire cable;

the strap having a length doubled over upon itself to form a neck that extends to a loop, the doubled over length having an inner side and an opposing outer side;

a fitting engaging the doubled over length of the strap;

a transverse bar portion on the fitting, the bar portion having a convex face abutting the inner side of the loop;

a pair of transverse arm portions on the fitting defining an opening therebetween, the opening receiving the neck and having opposing strap-engaging surfaces abutting the outer side of the neck and cooperating to hold the inner side against the convex face, and fastening means for connecting the fixture to a fastener.

Preferably the convex face and the opening are symmetrical about a longitudinal plane bisecting the fitting, and the convex face tapers longitudinally from a narrow edge proximate the opening to a broad rounded edge.

Preferably the transverse bar portion is formed of two parts joined at the plane, the fastening means comprises a transverse recess formed in each of the parts, the recesses being aligned to form a transverse aperture in the fitting.

Preferably the fastening means comprises a ring having a straight axle portion pivotably received in the transverse aperture.

Preferably the at least one longitudinally extending multi-strand wire cable comprises a pair of multi-strand wire cables, each received in a respective one of two parallel envelopes disposed on opposite longitudinal edges of the strap.

Preferably each envelope is tubular and formed in a flexible polymer strip, each strip further including a flange portion, the strap further comprising two webbings, the flange portion of each reinforcement strip received between adjacent longitudinal edges of the webbings with a longitudinal seam connecting each flexible polymer strip to the webbings.

In another aspect of the present invention there is provided a fitting for forming a loop in a longitudinal end of a carrying strap assembly reinforced by at least one longitudinally extending multi-strand wire cable, the fitting including:

a transverse bar portion having a convex face with a transverse axis, the convex face being adapted for abutting the strap to form a loop at an end of the strap, and a pair of transverse arm portions on the fitting defining an opening therebetween, the opening having opposing strap-engaging surfaces to abut outer faces of the loop, whereby the opposing surfaces cooperate to hold the loop against the convex face, and wherein the convex face and the opening are symmetrical about a longitudinal plane bisecting the fitting, the convex face tapers longitudinally from a narrow edge proximate the opening to a broad rounded edge, the transverse bar portion is formed of two parts joined at the plane, and a transverse recess is formed in each of the parts, the recesses being aligned to form a transverse aperture in the fitting.

In still another aspect of the present invention there is provided a carrying strap including: a pair of multi-strand wire cables received in parallel envelopes disposed on opposite longitudinal edges of the strap, wherein each envelope is tubular and formed in a flexible polymer strip, each strip further including a flange portion, the strap further comprising two webbings, the flange portion of each flexible polymer strip received between adjacent longitudinal edges of the webbings with a longitudinal seam connecting each reinforcement strip to the webbings.

The fitting provides in one component, both a large convex surface about which the doubled over portion of the strap is passed and an opening through which the neck of the doubled over portion is received, thereby providing a neat loop in the strap and avoiding permanent deformation of the reinforcing cables.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 2:
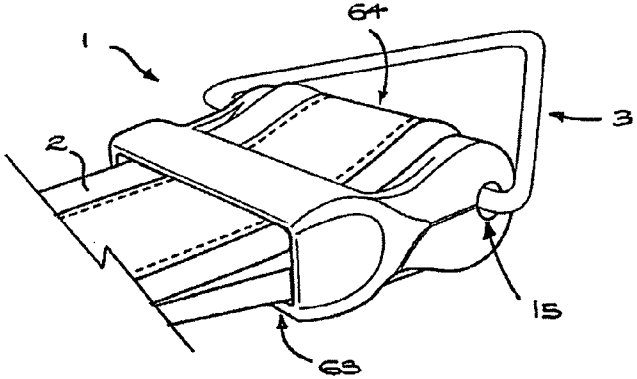
FIG. 2 is a pictorial view of part of the carrying strap assembly of FIG. 1.
Figure 3:
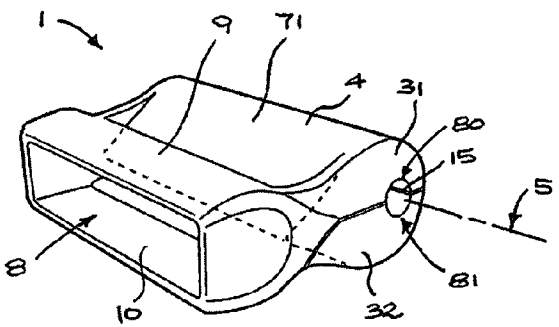
FIG. 3 is a pictorial view of the fitting of FIG. 1.
Figure 1:
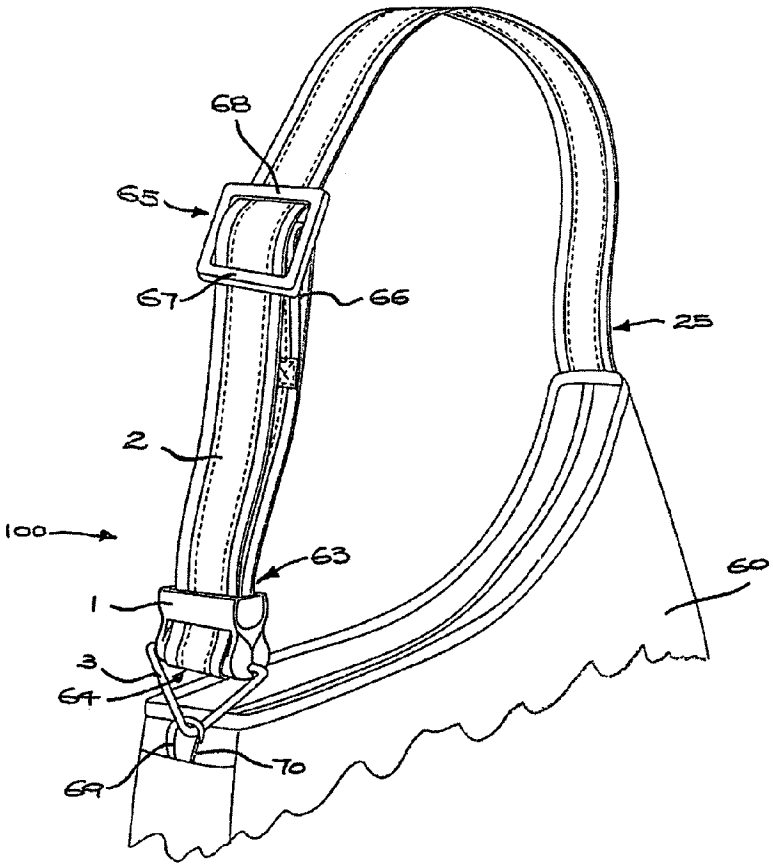
FIG. 1 is a pictorial view of a carrying strap assembly of the invention fitted to a bag.
Figure 5:
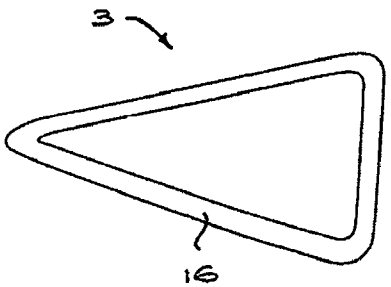
FIG. 5 is a pictorial view of the ring of FIG. 1.

Referring to FIGS. 1 and 5, a bag 60 includes a carrying strap or shoulder strap assembly 100. The carrying strap assembly 100 includes a fitting 1, an elongate strap 2 and a ring 3. A length-adjustment buckle 65 has a central cross bar (not shown) and two end bars 67, 68. The strap 2 passes under the end bars 67, 68 and over the central bar before it passes through the fitting 1 and a length of the strap is doubled over upon itself to form a neck 63 that extends to a loop 64. The longitudinal end of the strap 2 is then fixed in a loop 66 around the cross bar. A transverse aperture 15 in the fitting 1 receives the ring 3. A fastener in the form of hook 69 fixed to the bag 60 releasably fastens the ring 3 to the bag 60. A spring keeper 70 is fixed to the hook 69 to avoid unintentional disconnection. Thus one end of the strap assembly 100 is connected to the bag 60, via the hook 69, while the other end 25 is fixed, as by a seam (not shown), directly to the bag 60.

The fitting 1 is bisected by a longitudinal plane 30, and is formed from two separate parts 31, 32 moulded from polymer and joined at the plane 30. The parts 31, 32 may be connected as by a "snap fit", by resilient deformation of mutually engaged portions of each part (not shown).

Figure 4:
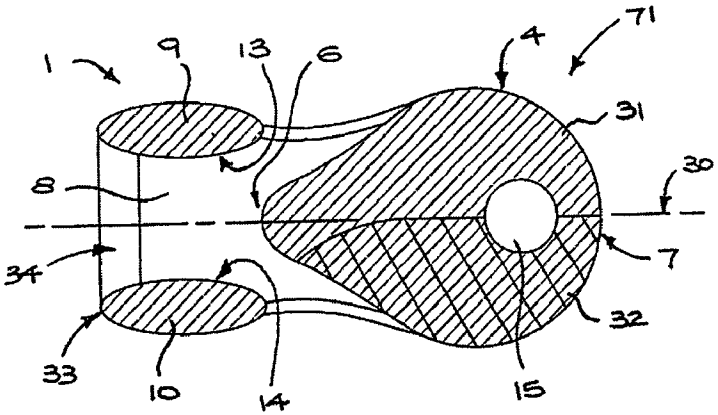
FIG. 4 is a longitudinal sectional view of the fitting of FIG. 3.

The fitting 1 has transverse bar portion 71 with a convex face 4 bisected by the plane 30 and having a tapered "teardrop" form in longitudinal section. As best seen in FIG. 4, the transverse bar portion 71 is formed from the two parts 31, 32 joined at the plane 30 At one longitudinal end the face 4 has a rounded relatively broad edge 7 which tapers to a narrower edge 6 at the longitudinally opposing end.

The aperture 15 extends transversely through the fitting 1 adjacent the broader edge 7. The aperture 15 is bisected at its widest section by the plane 30 and has a transverse axis 5. The aperture 15 is formed from aligned transverse recesses 80, 81 formed in each of the parts 31, 32.

The fitting 1 includes an opening 8 disposed adjacent narrower edge 6. The opening 8 is defined by the transversely elongated arm portions 9, 10 bounding it on opposing sides. The opening 8 is sized for receiving the neck 63 of the strap 2 and is defined by pair of transverse arm portions 9, 10. The arm portions 9, 10 have respective strap-engaging surfaces 13, 14 formed on the inside of the opening. A mouth 34 of the opening 8 is bounded by a rim 33 lying in a plane generally perpendicular to the plane 30. The transverse width of the opening 8 is approximately the same width as the strap 2, while the rounded edge 7 is slightly wider than the strap 2. Both the opening 8 and the bar portion 71 generally have reflective symmetry about the plane 30.

The ring 3 is generally triangular and formed of steel and includes a transverse, straight axle part 16.

Figure 6:
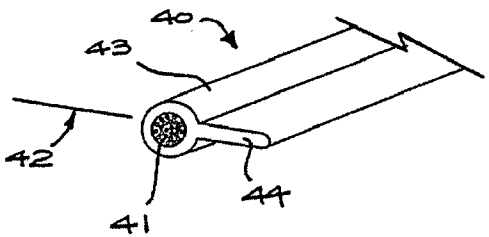
FIG. 6 is a fragmentary pictorial view of a reinforcing strip of the strap of FIG. 1.

FIG. 6 illustrates an edge reinforcement strip 40 forming part of the strap 2. The strip 40 includes a core comprising a multi-strand twisted wire cable 41 enveloped in a tubular envelope portion 43 which extends about the cable 41 and an integral flange portion 44. The strip 40 is extruded from a flexible polymer about the cable 41 bonding the cable 41 and the envelope portion 43. The integral flange portion 44 of the strip 40 is generally aligned with a plane 42 which bisects the tubular portion 43.

Figure 7:
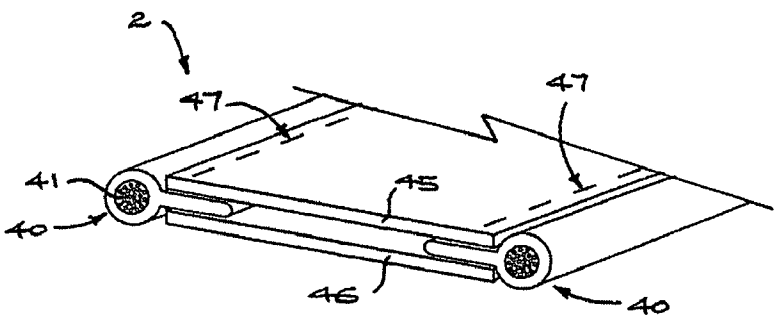
FIG. 7 is a fragmentary pictorial view of the strap of FIG. 1.

The strap 2 includes parallel reinforcement strips 40 along its opposite longitudinal edges, as shown in FIG. 7. The strap 2 is formed of two like webbings 45, 46 disposed to generally overlie one another with the flange portion 44 of each reinforcement strip received between adjacent longitudinal edges of the webbings 45, 46. A longitudinal seam 47 connects each reinforcement strip 40 to the webbings 45, 46 with the threads extending through the flange portion 44.

The fitting 1 and ring 3 are connected by placing the axle part 16 in the recesses 80, 81 and then pressing together the two parts 31, 32. When assembled ready for attachment to the bag 60, the strap 2 passes in a loop through the opening 8, around the convex face 4, and back through the opening 8. The opposing strap-engaging surfaces 13, 14 abut outer faces of the neck 63, keeping the inner faces of the doubled-over portion together and cooperating to hold the loop 64 against the convex face 4. The radius of curvature of the wider portion 7 is selected such that the wire cable in the loop at the end is only elastically deformed, avoiding the possibility for permanently kinking the wire. Tension in the strap 2 produces a clamping load on the fixture which tends to hold the parts 31, 32 together.

Aspects of the present invention have been described by way of example only and it should be appreciated that modifications and additions may be made thereto without departing from the scope thereof.

The invention claimed is:

1. A carrying strap assembly comprising:

an elongate strap reinforced by at least one longitudinally extending multi-strand wire cable;

the strap having a length doubled over upon itself to form a neck that extends to a loop, the doubled over length having an inner side and an opposing outer side;

a fitting engaging the doubled over length of the strap and the fitting having a longitudinal plane bisecting the fitting;

a transverse bar portion on the fitting, the bar portion having a convex face abutting the inner side of the loop and wherein the transverse bar portion is formed of two parts joined at the plane;

a pair of transverse arm portions on the fitting defining an opening therebetween, the opening receiving the neck and having opposing strap-engaging surfaces abutting the outer side of the neck and cooperating to hold the inner side against the convex face, and fastening means for connecting the fitting to a fastener, and the fastening means comprises a transverse recess formed in each of the parts, the recesses being aligned to form a transverse aperture in the fitting.

2. The carrying strap assembly of claim 1 wherein the convex face and the opening are symmetrical about the longitudinal plane bisecting the fitting, and the convex face tapers longitudinally from a narrow edge proximate the opening to a broad rounded edge.

3. The carrying strap assembly of claim 2 wherein the transverse bar portion is formed of two parts joined at the plane, the fastening means comprises a ring received in a transverse aperture in the fitting, the transverse aperture being formed by aligned transverse recesses, one recess formed in each of the parts, the ring having a straight axle portion pivotably received in the transverse aperture, and the at least one longitudinally extending multi-strand wire cable comprises a pair of multi-strand wire cables, each cable received in a respective one of two parallel envelopes disposed on opposite longitudinal edges of the strap, each envelope being tubular and formed in a flexible polymer strip, each strip further comprising a flange portion, the strap further comprising two webbings, the flange portion of each reinforcement strip received between adjacent longitudinal edges of the webbings with a longitudinal seam connecting each flexible polymer strip to the webbings.

4. The carrying strap assembly of claim 1 wherein the fastening means comprises a ring having a straight axle portion pivotably received in the transverse aperture.

5. The carrying strap assembly of claim 1 further comprising a bag having a fastener in the form of a hook fixed thereto, and wherein the strap has longitudinally opposing ends with the doubled over portion provided at a first end, and a ring being received in the hook to connect the first end to the bag, the second end being fixed to the bag by a seam.

6. The carrying strap assembly of claim 1 wherein the at least one longitudinally extending multi-strand wire cable comprises a pair of multi-strand wire cables, each received in a respective one of two parallel envelopes disposed on opposite longitudinal edges of the strap.

7. The carrying strap assembly of claim 6 wherein each envelope is tubular and formed in a flexible polymer strip, each strip further comprising a flange portion, the strap further comprising two webbings, the flange portion of each reinforcement strip received between adjacent longitudinal edges of the webbings with a longitudinal seam connecting each flexible polymer strip to the webbings.

8. A fitting for forming a loop in a longitudinal end of a carrying strap assembly reinforced by at least one longitudinally extending multi-strand wire cable, the fitting comprising:

a transverse bar portion having a convex face with a transverse axis, the convex face being adapted for abutting the strap to form a loop at an end of the strap, and a pair of transverse arm portions on the fitting defining an opening therebetween, the opening having opposing strap-engaging surfaces to abut outer faces of the loop, whereby the opposing surfaces cooperate to hold the loop against the convex face, and wherein the convex face and the opening are symmetrical about a longitudinal plane bisecting the fitting, the convex face tapers longitudinally from a narrow edge proximate the opening to a broad rounded edge, the transverse bar portion is formed of two parts joined at the plane, and a transverse recess is formed in each of the parts, the recesses being aligned to form a transverse aperture in the fitting.

9. A carrying strap comprising: a pair of multi-strand wire cables received in parallel envelopes disposed on opposite longitudinal edges of the strap, wherein each envelope is tubular and formed in a flexible polymer strip, each strip farther comprising a flange portion, the strap further comprising two webbings, the flange portion of each flexible between adjacent longitudinal edges of the webbings with a longitudinal seam connecting each reinforcement strip to the webbings.

10. The carrying strap of claim 9 wherein the strip is extruded over the cable.

11. The carrying strap assembly of claim 9 wherein the strap has a length doubled over upon itself to form a neck that extends to a loop, the doubled over length having an inner side and an opposing outer side.

12. The carrying strap of claim 11 and further comprising a fitting engaging the doubled over length of the strap.

13. The carrying strap of claim 12 wherein the fitting further comprises a longitudinal plane bisecting the fitting, and the fitting has a transverse bar portion, the bar portion having a convex face abutting the inner side of the loop. and wherein the transverse bar portion is formed of two parts joined at the plane.

14. The carrying strap of claim 13 wherein the transverse bar portion is formed of two parts joined at the plane.

15. The carrying strap of claim 14 wherein the fitting has a pair of transverse arm portions defining an opening therebetween, the opening receiving the neck and having opposing strap-engaging surfaces abutting the outer side of the neck and cooperating to hold the inner side against the convex face.

16. The carrying strap of claim 15 wherein the convex face and the opening are symmetrical about the longitudinal plane bisecting the fitting, and the convex face tapers longitudinally from a narrow edge proximate the opening to a broad rounded edge.

17. The carrying strap assembly of claim 13 wherein the transverse bar portion is formed of two parts joined at the plane and wherein the strip is extruded over the cable.

18. The carrying strap of claim 17 wherein the fastening means comprises a transverse recess formed in each of the parts, the recesses being aligned to form a transverse aperture in the fitting.

19. The carrying strap of claim 9 and further comprising a bag having a fastener in the form of a hook fixed thereto, and wherein the strap has longitudinally opposing ends with the doubled over portion provided at a first end, and a ring being received in the hook to connect the first end to the bag, the second end being fixed to the bag by a seam.

* * * * *